US012497724B2

(12) United States Patent
Kim et al.

(10) Patent No.: US 12,497,724 B2
(45) Date of Patent: Dec. 16, 2025

(54) WASHING MACHINE AND CONTROL METHOD THEREOF

(71) Applicant: SAMSUNG ELECTRONICS CO., LTD., Suwon-si (KR)

(72) Inventors: Minsung Kim, Suwon-si (KR); Hooijoong Kim, Suwon-si (KR); Jeonghoon Kang, Suwon-si (KR); Sung Han, Suwon-si (KR); Kwanwoo Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 48 days.

(21) Appl. No.: 18/442,713

(22) Filed: Feb. 15, 2024

(65) Prior Publication Data

US 2024/0229324 A1 Jul. 11, 2024

Related U.S. Application Data

(63) Continuation of application No. PCT/KR2023/020196, filed on Dec. 8, 2023.

(30) Foreign Application Priority Data

Jan. 11, 2023 (KR) ..... 10-2023-0004334

(51) Int. Cl.
*D06F 35/00* (2006.01)
*D06F 37/30* (2020.01)
*D06F 105/48* (2020.01)

(52) U.S. Cl.
CPC ..... *D06F 35/006* (2013.01); *D06F 37/304* (2013.01); *D06F 2105/48* (2020.02)

(58) Field of Classification Search
CPC ..... D06F 35/006
See application file for complete search history.

(56) References Cited

U.S. PATENT DOCUMENTS 8,561,437 B2 10/2013 Lee et al.
9,528,212 B2 12/2016 Lee et al.
(Continued)

FOREIGN PATENT DOCUMENTS

CN 113330155 A 8/2021
JP 2006-167236 A 6/2006
(Continued)

OTHER PUBLICATIONS

International Search Report dated Mar. 28, 2024 for International Application No. PCT/KR2023/020196.
(Continued)

*Primary Examiner* — Jason Y Ko
(74) *Attorney, Agent, or Firm* — STAAS & HALSEY LLP

(57) ABSTRACT

A washing machine according to an aspect of the disclosure includes: a tub to accommodate wash water; a drum inside the tub; a driving device configured to rotate the drum, the driving device including: a coupler configured to move between a first position and a second position to adjust a rotational speed of the drum, and a solenoid configured to move the coupler between the first position and the second position in response to an electric current flowing through the solenoid; a circulation pump configured to operate to circulate the wash water in the tub; and a controller configured to determine when the circulation pump is operating and to control the electric current flowing through the solenoid to move the coupler between the first position and the second position while the circulation pump is determined to be operating.

15 Claims, 16 Drawing Sheets

(56) References Cited

U.S. PATENT DOCUMENTS

| | | | |
|---|---|---|---|
| 9,752,268 | B2 | 9/2017 | Kim et al. |
| 11,255,037 | B2 | 2/2022 | Lee et al. |
| 11,280,040 | B2 | 3/2022 | Lee et al. |
| 11,332,872 | B2 | 5/2022 | Yoneda et al. |
| 11,365,504 | B2 | 6/2022 | Sonoda et al. |
| 2017/0002499 | A1 | 1/2017 | Lv et al. |

FOREIGN PATENT DOCUMENTS

| | | | |
|---|---|---|---|
| JP | 2012-223488 | A | 11/2012 |
| JP | 6903400 | B2 | 7/2021 |
| KR | 10-2010-0086897 | A | 8/2010 |
| KR | 10-2014-0090711 | A | 7/2014 |
| KR | 10-1466336 | B1 | 11/2014 |
| KR | 10-2015-0087689 | A | 7/2015 |
| KR | 10-2016-0041614 | | 4/2016 |
| KR | 10-2016-0106142 | A | 9/2016 |
| KR | 10-2018-0082910 | A | 7/2018 |
| KR | 10-1980854 | B1 | 5/2019 |
| KR | 10-2020-0003517 | A | 1/2020 |
| KR | 10-2096792 | B1 | 4/2020 |
| KR | 10-2123429 | | 6/2020 |
| KR | 10-2186367 | B1 | 12/2020 |
| KR | 10-2021-0054813 | | 5/2021 |

OTHER PUBLICATIONS

Written Opinion of the International Searching Authority dated Mar. 28, 2024 for International Application No. PCT/KR2023/020196.

Extended European Search Report dated Sep. 26, 2025 for European Application No. 23916419.7.

FIG. 15

| | dBA |
|---|---|
| NOISE DURING WASHING | 51 |
| NOISE DURING CIRCULATION | 51 |
| SWITCH NOISE(0.4s) | 48 |

WASHING MACHINE AND CONTROL METHOD THEREOF

CROSS-REFERENCE TO RELATED APPLICATIONS

This is a continuation application of International Application No. PCT/KR2023/020196, filed Dec. 8, 2023, which is incorporated herein by reference in its entirety, it being further noted that foreign priority benefit is based upon Korean Patent Application No. 10-2023-0004334, filed Jan. 11, 2023, which is incorporated herein by reference in its entirety.

TECHNICAL FIELD

The disclosure relates to a washing machine and a control method thereof, and more specifically, to a washing machine capable of reducing noise and a control method thereof.

BACKGROUND ART

In general, a washing machine includes a tub and a drum rotatably installed in the tub, and may wash laundry by rotating the drum accommodating the laundry inside the tub. A washing machine may perform a wash process of washing laundry, a rinse process of rinsing the washed laundry, and a spin-dry process of spin-drying the laundry.

In particular, in the spin-dry process, water absorbed in the laundry may be separated from the laundry by accelerating and decelerating the drum containing the laundry at high speed.

Unlike the other processes, the spin-dry process has a high rotational speed of the drum, and thus noise may be generated while adjusting the rotational speed of the drum.

DISCLOSURE

Technical Problem

The disclosure is directed to providing a washing machine that may mask a clutch position switch noise with a circulation operation noise by performing a clutch position switch for controlling a rotational speed of a drum while a circulation pump is operating to allow a user not to perceive the clutch position switch noise, and a control method thereof.

Technical Solution

One aspect of the disclosure provides a washing machine including: a tub to accommodate wash water; a drum inside the tub; a driving device configured to rotate the drum the driving device including: a coupler configured to move between a first position and a second position to adjust a rotational speed of the drum, and a solenoid configured to move the coupler between the first position and the second position in respond to an electric current flowing through the solenoid; a circulation pump configured to operate to circulate the wash water in the tub; and a controller configured to determine when the circulation pump is operating and to control the electric current flowing through the solenoid to move the coupler between the first position and the second position while the circulation pump is determined to be operating.

The controller may be configured to control the electric current flowing through the solenoid to move the coupler between the first position and the second position by changing a direction that the electric current is supplied to the solenoid between a first direction and a second direction.

The controller may be configured to control the driving device to rotate the drum for a plurality of rotation periods, and control the electric current flowing through the solenoid to move the coupler between the first position and the second position before a last rotation period of the plurality of rotation periods of the drum starts while the circulation pump is operating in a wash process or a rinse process.

The controller may be configured to start operating the circulation pump before controlling the electric current flowing through the solenoid to move the coupler between the first position and the second position, and stop operating the circulation pump after controlling the electric current flowing through the solenoid to move the coupler between the first position and the second position.

The controller may be configured to operate the circulation pump during the wash process or the rinse process.

The plurality of rotation periods of the drum may include a period in which the drum alternately rotates clockwise (CW) and counterclockwise (CCW).

The controller may be configured to control the driving device to rotate the drum for a plurality of rotation periods, and may be configured to control the electric current flowing through the solenoid to move the coupler between the first position and the second position, after a first rotation period of the plurality of rotation periods of the drum is completed while the circulation pump is determined to be operating in a wash process or a rinse process.

The controller may be configured to start operating the circulation pump before controlling the electric current flowing through the solenoid to move the coupler between the first position and the second position, and stop operating the circulation pump after controlling the electric current flowing through the solenoid to move the coupler between the first position and the second position.

The controller may be configured to operate the circulation pump during the wash process or the rinse process.

The plurality of rotation periods of the drum may include a period in which the drum alternately rotates clockwise (CW) and counterclockwise (CCW).

The controller may be configured to change the direction that electric current is supplied to the solenoid to move the coupler from the second position to the first position, in response to switching a wash process or a rinse process to a spin-dry process, and change the direction that electric current is supplied to the solenoid to move the coupler from the first position to the second position, in response to switching the spin-dry process to the wash process or the rinse process.

When the driving device rotates the drum, the drum may be configured to rotate at a first speed when the coupler is located in the first position, and rotate at a second speed when the coupler is located in he second position. The first speed may be higher than the second speed.

One aspect of the disclosure provides a control method of a washing machine including a tub to accommodate wash water, a drum inside the tub, a circulation pump configured to operate to circulate the wash water in the tub, and a driving device configured to rotate the drum, the driving device including a coupler configured to move between a first position and a second position to adjust a rotational speed of the drum, and a solenoid configured to move the coupler between the first position and the second position in response to an electric current flowing through the solenoid the control method including: determining when the circulation pump is operating; and controlling the electric current flowing through the solenoid, to move the coupler between the first position and the second position while the circulation pump is determined to be operating.

The controlling may include changing a direction that the electric current is supplied to the solenoid.

The control method may include rotating the drum with the driving device for a plurality of rotation periods; and the controlling may include controlling the electric current flowing through the solenoid to move the coupler between the first position and the second position before a last rotation period of the plurality of rotation periods of the drum starts while the circulation pump is determined to be operating in a wash process or a rinse process.

The controlling may include operating the circulation pump before changing the position of the coupler.

The controlling may include operating the circulation pump during the wash process or the rinse process.

The plurality of rotation periods of the drum may include a period in which the drum alternately rotates clockwise (CW) and counterclockwise (CCW).

The control method may include rotating the drum with the driving device for a plurality of rotation periods; and the controlling may include controlling the electric current flowing through the solenoid to move the coupler between the first position and the second position, after a first rotation period of the plurality of rotation periods of the drum is completed while the circulation pump is determined to be operating in a wash process or a rinse process.

The controlling may include operating the circulation pump before controlling the electric current flowing through the solenoid to move the coupler between a first position and a second position.

The controlling may include operating the circulation pump during the wash process or the rinse process.

The plurality of rotation periods of the drum may include a period in which the drum alternately rotates clockwise (CW) and counterclockwise (CCW).

The controlling may include changing the direction that electric current is supplied to the solenoid to move the coupler from the second position to the first position, in response to switching a wash process or a rinse process to a spin-dry process, and changing the direction that electric current is supplied to the solenoid to move the coupler from the first position to the second position, in response to switching the spin-dry process to the wash process or the rinse process.

The controlling may include rotating, with the driving device, the drum at a first speed when the coupler is located in the first position, and rotating, with the driving device, the drum at a second speed when the coupler is located in the second position. The first speed may be higher than the second speed.

Advantageous Effects

According to an aspect of the disclosure, a washing machine and a control method thereof may mask a clutch position switch noise with a circulation operation noise by performing a clutch position switch for controlling a rotational speed of a drum while a circulation pump is operating, thereby allowing a user not to perceive the clutch position switch noise.

DESCRIPTION OF DRAWINGS

FIG. 15 is a diagram illustrating a level of noise generated during circulation operation and clutch position switch.

MODES OF THE DISCLOSURE

Figure 1:
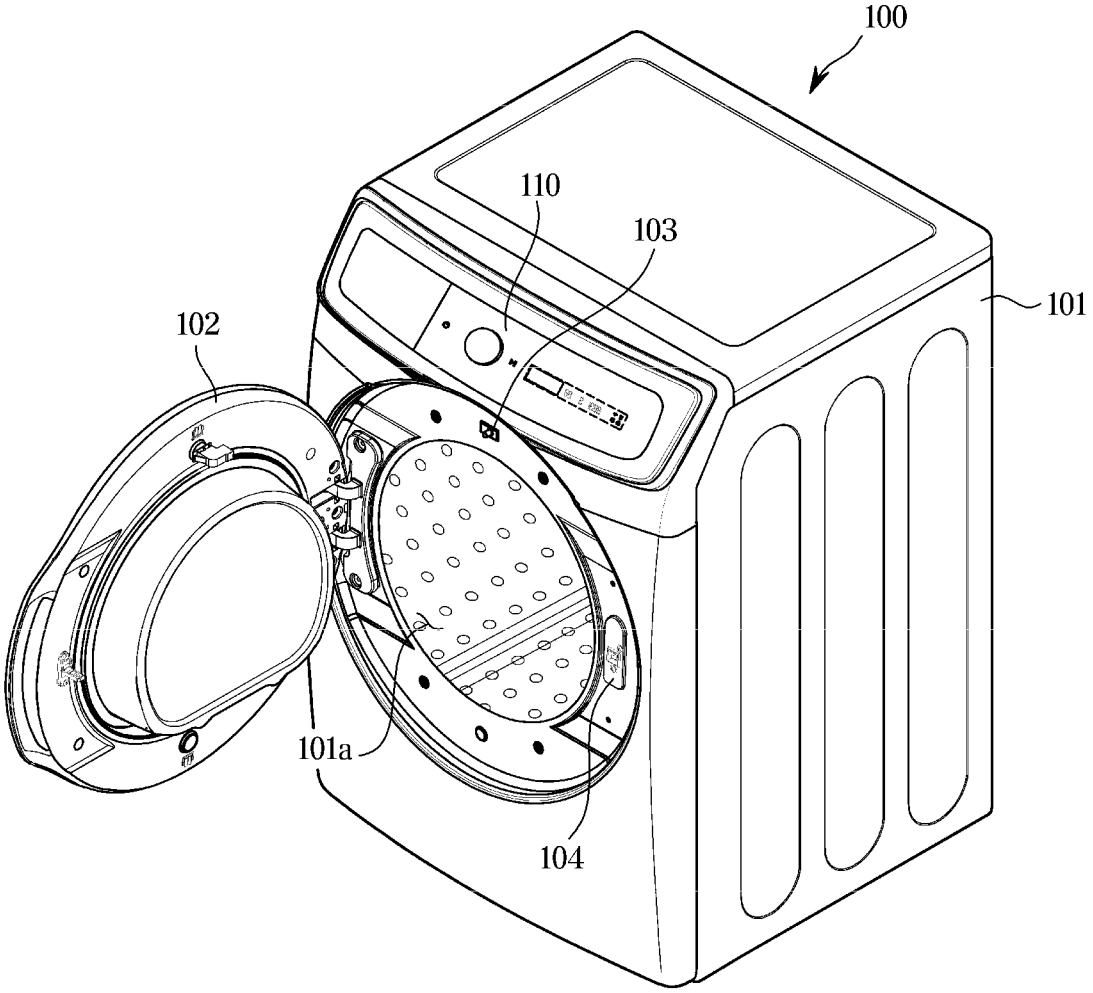
FIG. 1 is a view illustrating an exterior of a washing machine according to an embodiment.

Various embodiments and the terms used herein are not intended to limit the technology disclosed herein to specific forms, and the disclosure should be understood to include various modifications, equivalents, and/or alternatives to the corresponding embodiments.

In describing the drawings, similar reference numerals may be used to designate similar constituent elements.

A singular expression may include a plural expression unless otherwise indicated herein or unless the context clearly indicates otherwise.

The terms "A or B," "at least one of A or/and B," or "one or more of A or/and B," "A, B or C," "at least one of A, B or/and C," or "one or more of A, B or/and C," and the like used herein may include any and all combinations of one or more of the associated items listed.

The term "and/or" includes a plurality of combinations of relevant items or any one item among a plurality of relevant items.

Herein, the terms "a first", "a second", "the first", "the second", etc. may be used simply to distinguish an element from other elements, but are not limited to any other aspect (e.g., importance or order) of elements.

When an element (e.g., a first element) is referred to as being "(functionally or communicatively) coupled" or "connected" to another element (e.g., a second element), the first element may be connected to the second element directly (e.g., wired), wirelessly, or through a third element.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

When an element is said to be "connected," "coupled," "supported," or "contacted" to another element, this includes not only when elements are directly connected, coupled, supported, or contacted, but also when elements are indirectly connected, coupled, supported, or contacted through a third element.

Throughout the description, when an element is "on" another element, this includes not only when the element is in contact with the other element, but also when there is another element between the two elements.

A washing machine according to various embodiments may perform washing, rinsing, spin-drying, and drying processes. The washing machine is an example of a clothes care apparatus, and the clothes care apparatus is a concept including a device capable of washing clothes (objects to be washed, and objects to be dried), a device capable of drying clothes, and a device capable of washing and drying clothes.

The washing machine according to various embodiments may include a top-loading washing machine in which a laundry inlet for inserting or withdrawing laundry is provided to face upward, or a front-loading washing machine in which a laundry inlet is provided to face forward. The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass sequentially through the laundry inlet, the tub opening, and the drum opening, and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Alternatively, water may be supplied to the tub without passing through the detergent supply device.

The water supply valve may open or close the water supply pipe in response to an electrical signal of a controller. The water supply valve may allow or block the supply of water to the tub from an external water supply source. The water supply valve may include a solenoid valve configured to open and close in response to an electrical signal.

The washing machine may include the detergent supply device configured to supply detergent to the tub. The detergent supply device may include a manual detergent supply device that requires a user to input detergent to be used for each washing, and an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with detergent via the detergent supply device. Water mixed with detergent may be supplied into the tub. Detergent is used as a term including detergent for pre-washing, detergent for main washing, fabric softener, bleach, etc., and the detergent box may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include a Liquid Crystal Display (LCD) panel, a Light Emitting Diode (LED) panel, or a speaker.

The washing machine may include a communication module for wired and/or wireless communication with an external device.

The communication module may include at least one of a short-range wireless communication module and a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to one embodiment, the communication module may include a wireless communication module (e.g., a cellular communication module, a short-range wireless communication module, or a Global Navigation Satellite System (GNSS) communication module) or a wired communication module (e.g., a Local Area Network (LAN) communication module, or a power line communication module). Among these communication modules, the corresponding communication module may communicate with an external device through a first network (e.g., a short-range wireless communication network such as Bluetooth, Wireless Fidelity (Wi-Fi) direct, or Infrared Data Association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a Near Field Communication module, a WLAN (Wi-Fi) communication module, and a Zigbee communication module, an infrared data association (IrDA) communication module, a Wi-Fi Direct (WFD) communication module, an Ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server on a mobile communication network.

According to one embodiment, the communication module may communicate with an external device such as a server, a user device and other home appliances through an Access Point (AP). The AP may connect a Local Area Network (LAN), to which a washing machine or a user device is connected, to a Wide Area Network (WAN) to which a server is connected. The washing machine or the user device may be connected to the server through the WAN. The controller may control various components of the washing machine (e.g., the drive motor, and the water supply valve). The controller may control various components of the washing machine to perform at least one operation including water supply, washing, rinsing, and/or spin-drying according to a user input. For example, the controller may control the drive motor to adjust the rotational speed of the drum or control the water supply valve of the water supply device to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter embodiments according to the disclosure will be described in detail with reference to the accompanying drawings.

Figure 2:
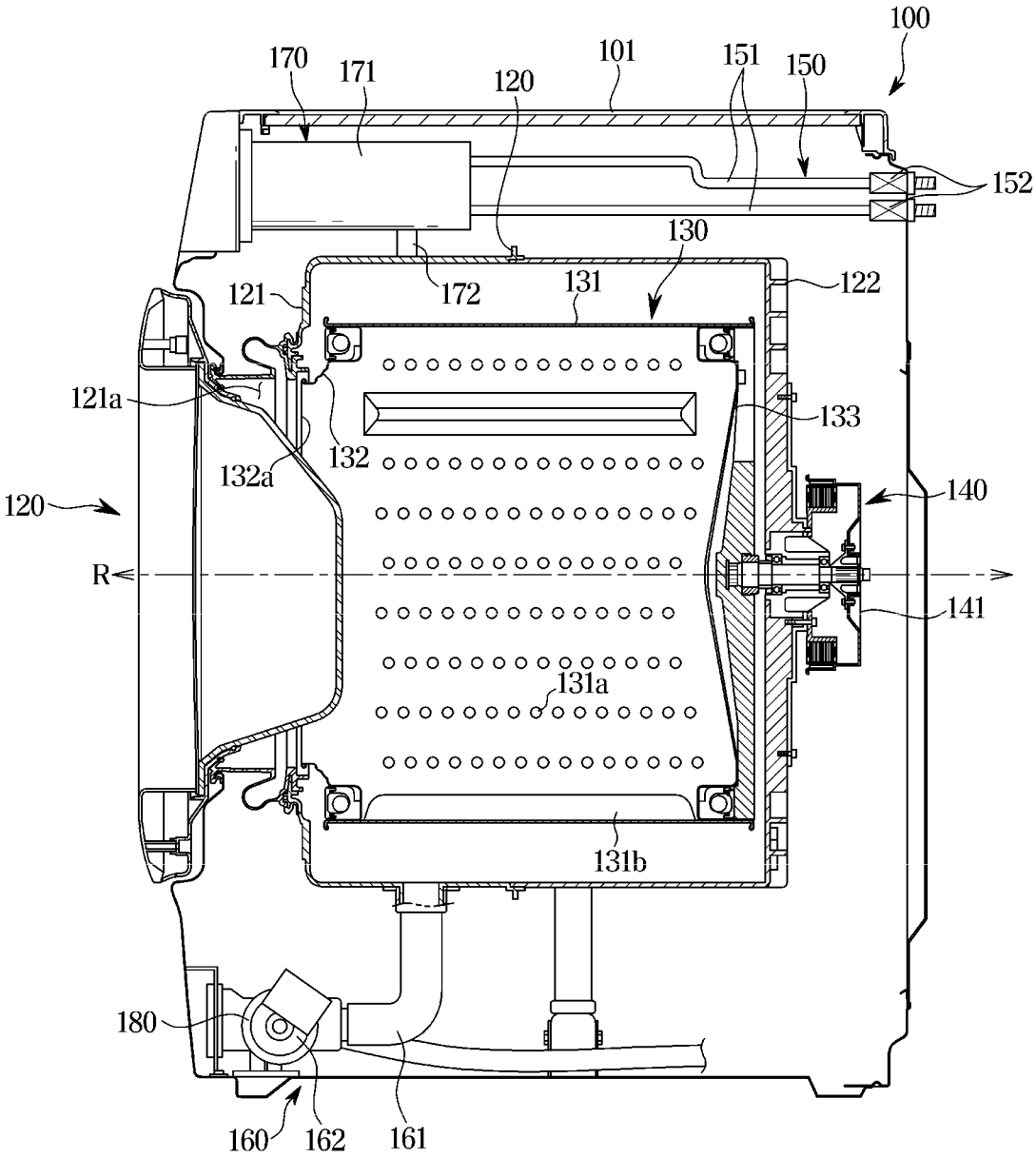
FIG. 2 is a side cross-sectional view of the washing machine according to an embodiment.

FIG. 1 is a view illustrating an exterior of a washing machine according to an embodiment. FIG. 2 is a side cross-sectional view of the washing machine according to an embodiment.

Referring to FIG. 1 and FIG. 2, the configuration of a washing machine 100 is described.

The washing machine 100 according to an embodiment may be a drum-type washing machine that rotates a drum 130 and causes laundry to repeat rising and falling to wash the laundry, and a motor-operated washing machine that uses a water current generated by a pulsator when the drum 130 rotates to wash the laundry.

That is, a control method of the washing machine 100 according to the disclosure is applicable to both the drum-type washing machine and the motor-operated washing machine. However, in the embodiments described below, the drum-type washing machine is described as an example of the washing machine 100 for description.

Referring to FIG. 1 and FIG. 2, the washing machine 100 may include a cabinet 101. The washing machine 100 may further include a door 102, a control panel 110, a tub 120, the drum 130, a driving device 140, a water supply part 150, a drain part 160, and a detergent supply part 170, all of which are accommodated in the cabinet 101.

The cabinet 10 may have an opening 101*a* formed in a front side thereof, through which laundry may be put into or taken out of the drum 130.

The opening 101*a* may be provided with the door 102. The door 102 may be rotatably mounted on the front side of the cabinet 10 by a hinge.

The opening 101*a* may be opened or closed by the door 102, and the closing of the opening 101*a* by the door 102 may be detected by a door switch 103. In response to the opening 101*a* being closed to start operating the washing machine 100, the door 102 may be locked by a door lock 104.

On an upper front side of the cabinet 101, the control panel 110 is provided including an input part for receiving a user input for the washing machine 100 from a user and a display for displaying operation information of the washing machine 100.

The tub 120 may be provided inside the cabinet 101, and accommodate water for washing and/or rinsing.

The tub 120 may include tub front parts 121 having an opening 121*a* formed on a front side, and tub rear parts 122 having a cylindrical shape with a closed rear side.

The opening 121*a* configured to put laundry into or to take laundry out of the drum 130 provided in the tub 120 130 may be provided on a front side of the tub front parts 121. A bearing 122*a* configured to rotatably fix a motor 141 may be provided on a rear wall of the tub rear parts 122.

The drum 130 may be rotatably provided inside the tub 120 and may accommodate laundry.

The drum 130 may include a drum body 131 having a cylindrical shape, a drum front part 132 provided in front of the drum body 131, and a drum rear part 133 provided in a rear of the drum body 131.

An inner surface of the drum body 131 may be provided with through holes 131*a* connecting an inside of the drum 130 and an inside of the tub 120, and a lifter 131*b* configured to lift laundry to an upper portion of the drum 130 while the drum 130 rotates. The drum front part 132 may be provided with an opening 132*a* configured to put laundry into or take laundry out of the drum 130. The drum rear part 133 may be connected to a shaft of the motor 141 that rotates the drum 130.

The driving device 140 may include the motor 141 rotating the drum 130.

Details of the driving device will be described later.

The water supply part 150 may supply water to the tub 120.

The water supply part 150 may include a water supply pipe 151 connected to an external water supply source to supply water to the tub 120, and a water supply valve 152 provided on the water supply pipe 151.

The water supply pipe 151 is provided above the tub 120 and may extend from the external water supply source to a detergent box 171. Water may be guided to the tub 120 through the detergent box 171.

The water supply valve 152 may allow or block the supply of water from the external water supply source to the tub 120 in response to an electrical signal. The water supply valve 152 may include, for example, a solenoid valve that opens and closes in response to an electrical signal.

The drain part 160 may discharge water accommodated in the tub 120 and/or the drum 130 to the outside.

The drain part 160 includes a drain pipe 161 provided below the tub 120 and extending from the tub 120 to the outside of the cabinet 101, and a drain pump 162 provided on the drain pipe 161. The drain pump 162 may pump water in the drain pipe 161 to the outside of the cabinet 101.

The detergent supply part 170 may supply detergent to the tub 120 and/or the drum 130.

The detergent supply part 170 may include the detergent box 171 provided above the tub 120 to store detergent, and a mixing pipe 172 connecting the detergent box 171 to the tub 120.

The detergent box 171 may be connected to the water supply pipe 151, and water supplied through the water supply pipe 151 may be mixed with detergent in the detergent box 171. A mixture of detergent and water may be supplied to the tub 120 through the mixing pipe 172.

The drain part 160 may further include a circulation pump 180 in addition to the drain pump 162.

The circulation pump 180 may circulate wash water and/or rinse water stored in the tub by being operated during a wash process and/or a rinse process.

Hereinafter, the driving device for controlling a speed of the drum of the disclosure is described in detail.

Figure 3:
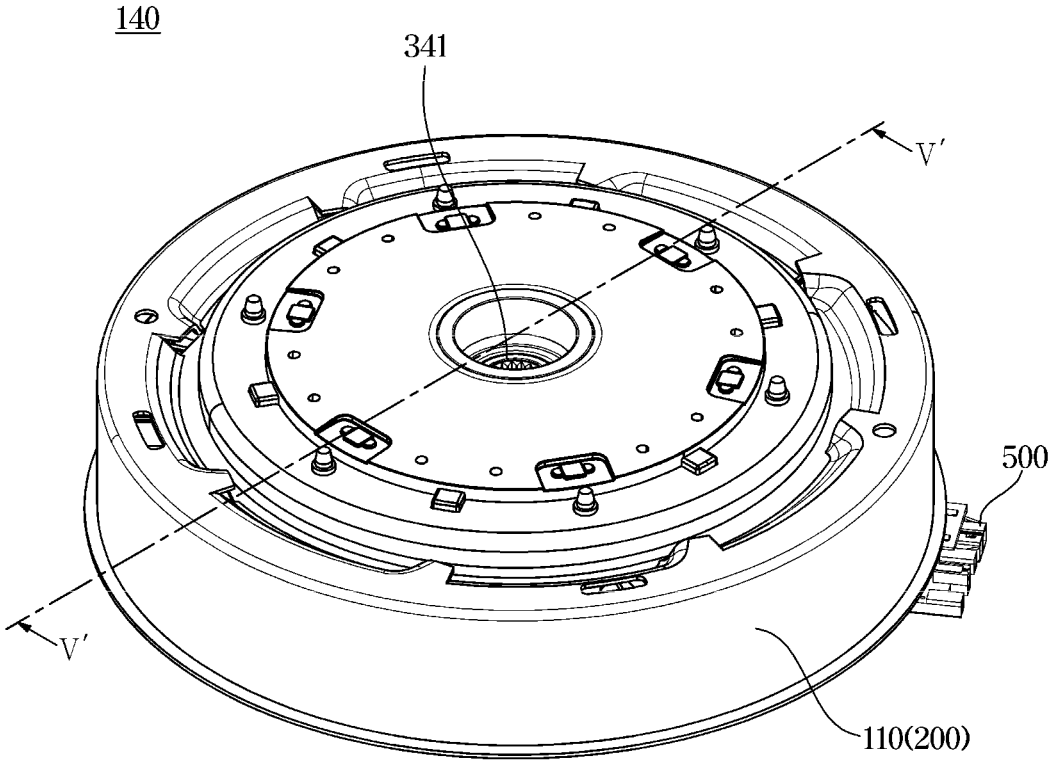
FIG. 3 is a perspective view of a driving device according to an embodiment.
Figure 4:
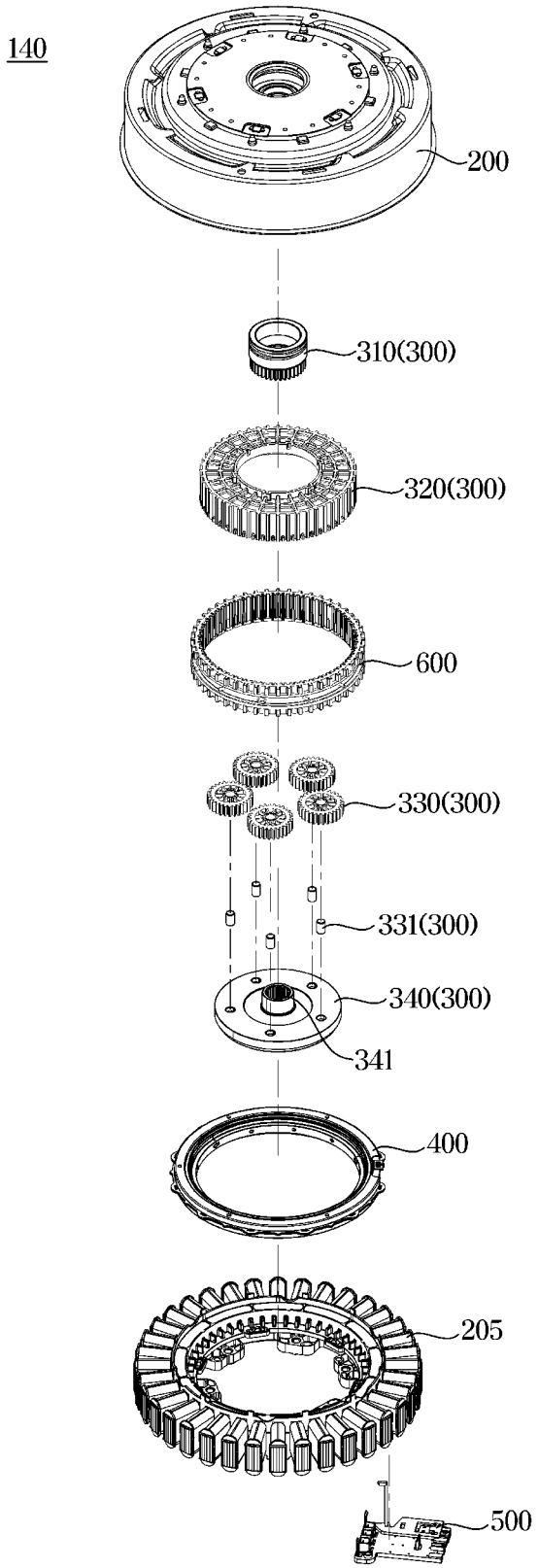
FIG. 4 is an exploded perspective view of the driving device shown in FIG. 3.
Figure 5:
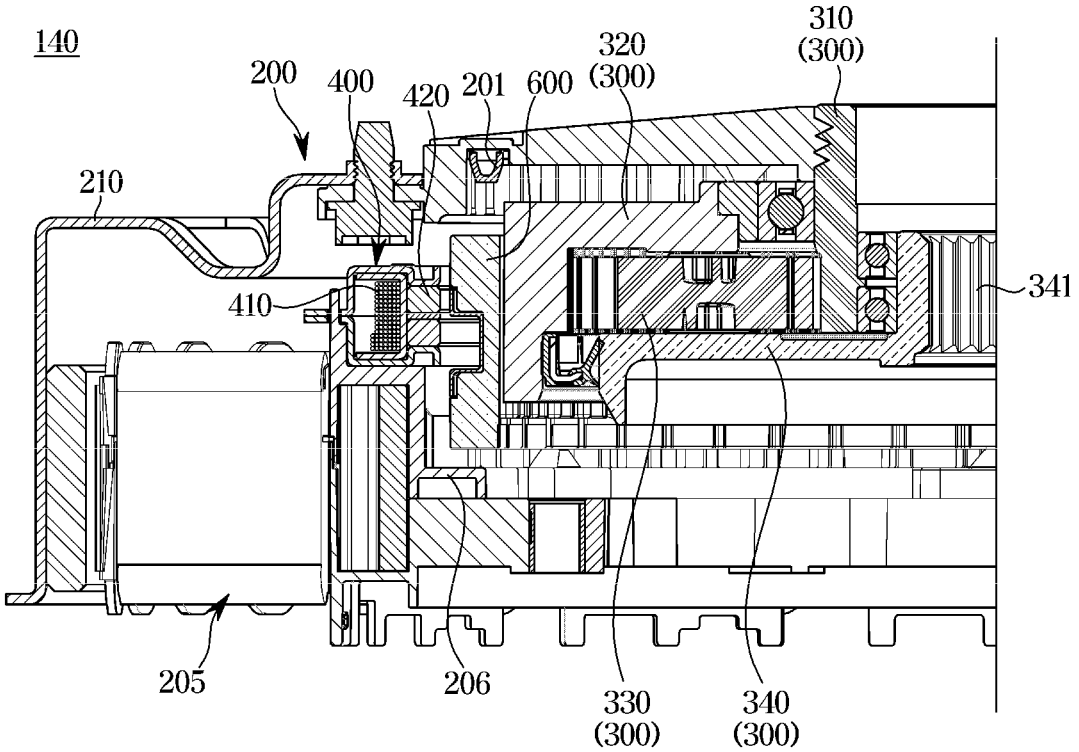
FIG. 5 is a cross-sectional view of the driving device shown in FIG. 3.

FIG. 3 is a perspective view of a driving device according to an embodiment. FIG. 4 is an exploded perspective view of the driving device shown in FIG. 3. FIG. 5 is a cross-sectional view of the driving device shown in FIG. 3.

The driving device 140 according to an embodiment is described with reference to FIG. 3 to FIG. 5.

The washing machine 1 may include the driving device 140. The driving device 140 may be configured to generate power for rotating the drum 130.

The driving device 140 may include a rotor 200. The rotor 200 may be rotatable about a rotation axis.

The rotor 200 may be configured to have a space inside. A stator 205 to be described later may be positioned in the space provided inside the rotor 200.

The rotor 200 may include a rotor case 210. The rotor case 210 may define an appearance of the rotor 200.

The rotor 200 may include a magnetic material. The magnetic material may respond to a magnetic field. The magnetic material may be attracted or repelled by a magnetic field.

The magnetic material may be coupled to the rotor case 210. The magnetic material may be positioned inside the rotor case 210.

The magnetic material may be positioned to correspond to a coil of the stator 205 to be described later.

The driving device 140 may include a stator 205. The stator 205 may be configured to be stationary relative to the rotor 200.

Electricity may be connected to the stator 205. The stator 205 may generate a magnetic field as electricity flows.

The stator 205 may include a coil (not shown). As electricity flows through the coil, the stator 205 may generate a magnetic field.

A plurality of coils may be provided. By sequentially flowing electricity through the plurality of coils, the coils may sequentially generate magnetic fields. The magnetic material may respond to the sequentially generated magnetic fields. Due to the reaction between the magnetic material and the coils, the rotor case 210 may move together with the magnetic material. Accordingly, the rotor 200 may be rotated about the rotation axis.

The driving device 140 may include a power supply module 500. The power supply module 500 may be configured to supply power.

The power supply module 500 may be electrically connected to the stator 205.

The power supply module 500 may also be electrically connected to a coupler lifting device 400 to be described later.

The driving device 140 may include a reduction gear module 300. The reduction gear module 300 may be configured to reduce a rotational speed of the rotor 200.

The reduction gear module 300 may be positioned inside the rotor 200.

The rotational speed of the rotor 200 may be too fast to be applied to the drum 130 of the washing machine 1. Because the drum 130 of the washing machine 1 has an appropriate rotational speed for washing, the rotational speed of the rotor 200 is required to be reduced in order for the drum 130 to rotate at an appropriate rotational speed. To this end, the reduction gear module 300 may be provided.

The reduction gear module 300 may include a sun gear 310.

The sun gear 310 may be coupled to the rotor 200.

The sun gear 310 may rotate at the same rotational speed as the rotor 200 by being coupled to the rotor 200.

The sun gear 310 may have a hole at a position corresponding to the rotation axis. A shaft may pass through the hole of the sun gear 310.

Teeth may be provided on an outer side of the sun gear 310.

The reduction gear module 300 may include a pinion gear 330.

The pinion gear 330 may be engaged with the sun gear 310 from an outside of the sun gear 310. Accordingly, the pinion gear 330 may make a rotational movement in a circumferential direction on the outer side of the sun gear 310 according to the rotation of the sun gear 310.

A plurality of pinion gears 330 may be provided. The plurality of pinion gears 330 may be positioned to surround the sun gear 310.

The reduction gear module 300 may include a ring gear 320.

The ring gear 320 may be defined to have a space therein and openings at both ends of the space.

The ring gear 320 may be positioned to surround the plurality of pinion gears 330. The ring gear 320 may be engaged with the pinion gear 330. The ring gear 320 may rotate while being engaged with the plurality of pinion gears 330.

The reduction gear module 300 may include a carrier 340.

The carrier 340 may be rotatably coupled to the pinion gear 330 by a shaft.

A gear shaft 331 may be positioned to pass through the carrier 340 and the pinion gear 330.

The carrier 340 may be engaged with the shaft. That is, the shaft is rotated at the same rotational speed as the carrier 340. Because the rotational speed of the shaft is the same as that of the drum 130, the rotational speed of the carrier 340 is the same as that of the drum 130. Accordingly, in response to reducing the rotational speed of the carrier 340, the rotational speed of the drum 130 may be reduced.

The carrier 340 may be coupled to the pinion gear 330 by the gear shaft 331. The carrier 340 may be rotated in response to a speed at which the pinion gear 330 rotates around the sun gear 310.

The carrier 340 may include carrier teeth 341. The carrier teeth 341 may be engaged with a shaft connected to the drum 130. Accordingly, the shaft connected to the drum 130 may be rotated according to the rotation of the carrier 340.

A reduction operation of the reduction gear module 300 is described.

While the rotor 200 rotates, the sun gear 310 may rotate together with the rotor 200.

While the sun gear 310 rotates, the pinion gear 330 engaged with the sun gear may rotate. In this instance, because the pinion gear 330 is engaged with the ring gear 320, the rotation may vary depending on a state of the ring gear 320.

In response to the ring gear 320 being stationary relative to the pinion gear 330, the pinion gear 330 may have a first rotational speed.

In response to the ring gear 320 moving relative to the pinion gear 330, the pinion gear 330 may have a second rotational speed.

The first rotational speed may be less than the second rotational speed.

In response to the pinion gear 330 making a rotational movement around the rotational axis of the sun gear 310 at the first rotational speed, the carrier 340 connected to the pinion gear 330 may rotate at a rotational speed corresponding to the first rotational speed.

In case of the first rotational speed, the reduction gear module 300 may reduce the rotational speed of the rotor 200 and transmit to the shaft.

The driving device 140 may include a coupler 600. The coupler 600 may be configured to move the ring gear 320 or stop the ring gear 320 relative to the pinion gear 330.

The coupler 600 may be positioned outside the ring gear 320. The coupler 600 may be engaged with the ring gear 320.

The coupler 600 may have one end positioned toward the rotor 200 and the other end positioned toward the stator 205.

The coupler 600 may be movable. While the coupler 600 moves, the coupler 600 may maintain engagement with the ring gear 320.

The coupler 600 may move to a first position. The coupler 600 may be engaged with the rotor 200 at the first position.

In response to the coupler 600 being in the first position, a rotational speed of the coupler 600 may be the same as that of the rotor 200. Because the coupler 600 may be engaged with the ring gear 320, a rotational speed of the ring gear 320 may be the same as that of the rotor 200. The ring gear 320 is movable relative to carrier 340. In this case, the reduction gear module 300 may not reduce the rotational speed of the rotor 200.

The coupler 600 may move to a second position. The coupler 600 may be engaged with the stator 205 at the second position.

Because the stator 205 is in a stationary state compared to the rotor 200, the rotation may be stopped while the coupler 600 is in the second position. Because the coupler 600 and the ring gear 320 are engaged, the ring gear 320 may be stopped.

Because the rotation of the ring gear 320 may be stopped in response to the coupler 600 being in the second position, the reduction gear module 300 may reduce the rotational speed of the rotor 200.

The coupler 600 may include a yoke 610.

The yoke 610 may have a magnetic material responsive to magnetism. While the yoke 610 is moved in response to a magnet, the coupler 600 may move.

The reduction gear module 300 may include the coupler lifting device 400.

The coupler lifting device 400 may be coupled to the stator 205.

The coupler lifting device 400 may be positioned outside a radial direction of the coupler 600.

The coupler lifting device 400 may be positioned to surround the coupler 600.

The coupler lifting device 400 may have a ring shape.

The coupler lifting device 400 may be electrically connected to the power supply module 500.

The coupler lifting device 400 may include a solenoid 410. The solenoid 410 may generate a magnetic field, in response to electricity flowing through the solenoid 410.

In response to electricity flowing through the solenoid 410 in one direction, a first magnetic field may be generated.

The first magnetic field generated by the solenoid 410 may interact with the yoke 610 to move the coupler 600 to the first position.

In response to electricity flowing through the solenoid 410 in another direction, a second magnetic field may be generated. The second magnetic field may have a direction different from the first magnetic field.

The second magnetic field generated by the solenoid 410 may interact with the yoke 610 to move the coupler 600 to the second position.

The coupler lifting device 400 may include a permanent magnet 420.

The permanent magnet 420 may be provided to fix a position of the coupler 600 by pulling the yoke 610, in response to the coupler 600 being in the first position or the second position.

The permanent magnet 420 may prevent the solenoid 410 from consuming power to fix the position of the coupler 600.

Figure 6:
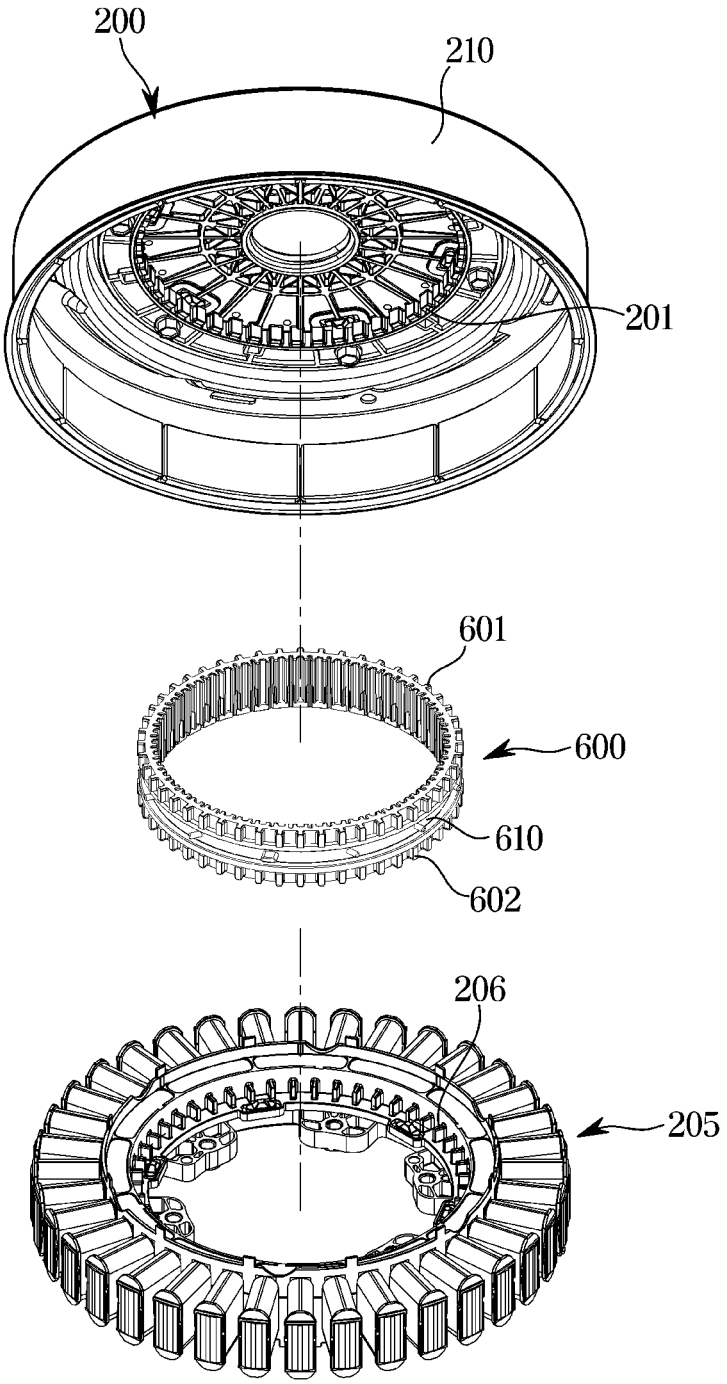
FIG. 6 is an exploded view of a coupler, a stator and a rotor shown in FIG. 4.
Figure 7:
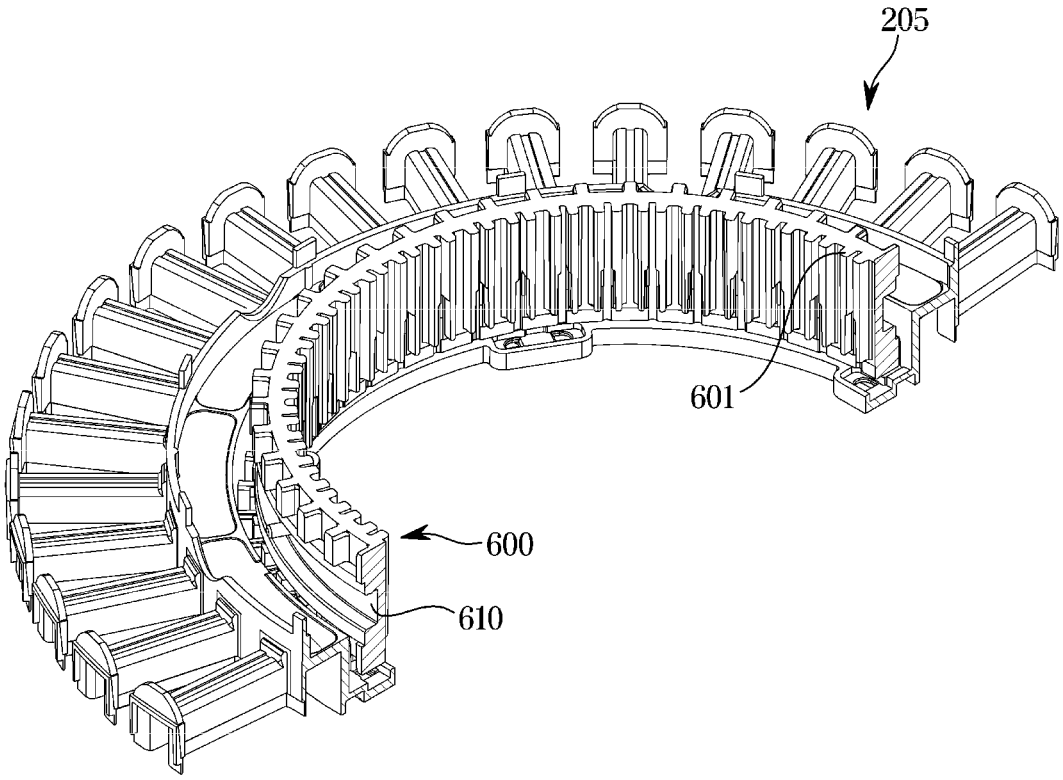
FIG. 7 is a cross-sectional perspective view in which the coupler and the stator shown in FIG. 4 are coupled to each other.
Figure 8:
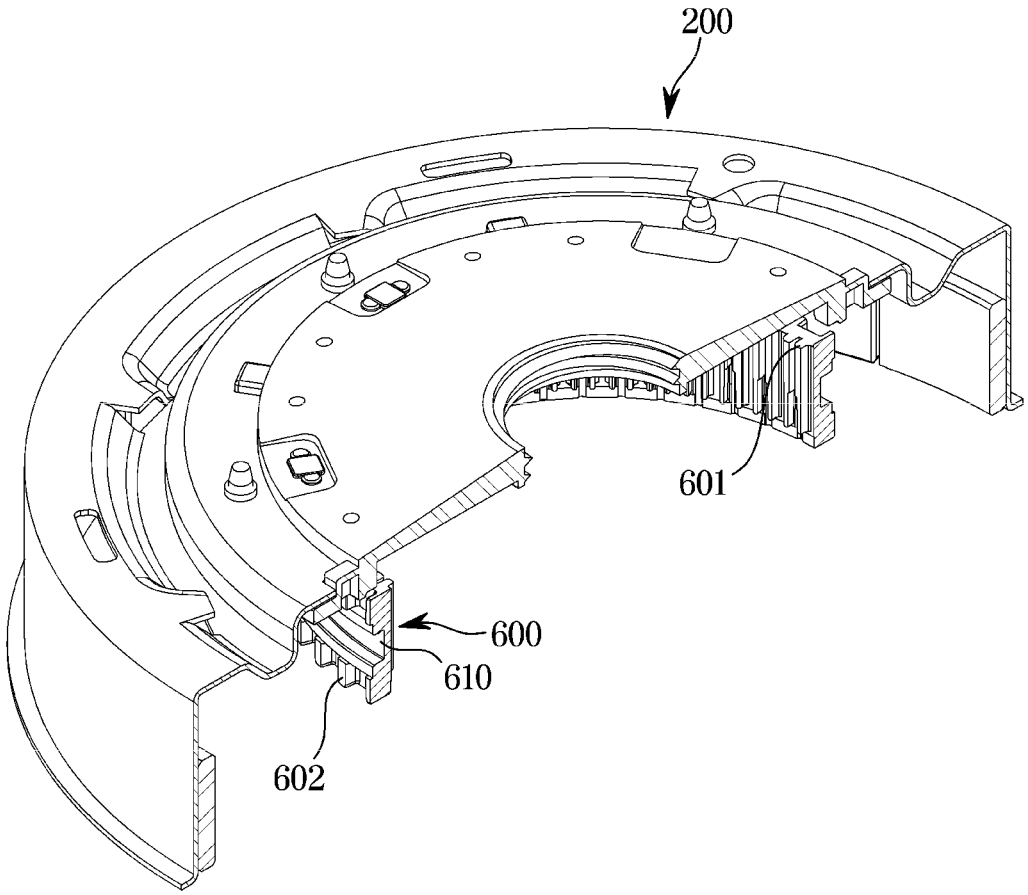
FIG. 8 is a cross-sectional perspective view in which the coupler and the rotor shown in FIG. 4 are coupled to each other.

FIG. 6 is an exploded view of the coupler 600, the stator 205 and the rotor 200 shown in FIG. 4. FIG. 7 is a cross-sectional perspective view in which the coupler 600 and the stator 205 shown in FIG. 4 are coupled to each other. FIG. 8 is a cross-sectional perspective view in which the coupler 600 and the rotor 200 shown in FIG. 4 are coupled to each other.

A configuration related to a movement of the coupler 600 according to an embodiment of the disclosure is described with reference to FIG. 6 to FIG. 8.

The coupler 600 may be positioned between the rotor 200 and the stator 205.

The coupler 600 may be engaged with the rotor 200 at the first position, and be prevented from being engaged with the stator 205.

The coupler 600 may be engaged with the stator 205 at the second position, and be prevented from being engaged with the rotor 200.

The coupler 600 may be coupled to the rotor 200 or the stator 205 through linear movement.

The coupler 600 may include coupler teeth.

The coupler teeth may be positioned on an outer side the coupler 600.

The coupler teeth may include first coupler teeth 601.

The first coupler teeth 601 may be positioned toward the rotor 200. The first coupler teeth 601 may be positioned to face the rotor 200.

The rotor 200 may include rotor teeth 201.

The rotor teeth 201 may be engaged with the first coupler teeth 601 in response to the coupler 600 being in the first position.

The coupler teeth may include second coupler teeth 602.

The second coupler teeth 602 may be positioned toward the stator 205. The second coupler teeth 602 may be positioned to face the stator 205.

The second coupler teeth 602 may be positioned closer to the stator 205 than the first coupler teeth 601.

The stator 205 may include stator teeth 206.

The stator teeth 206 may be engaged with the second coupler teeth 602 in response to the coupler 600 being in the second position.

However, in response to switching a position of the coupler 600, a noise of hitting between components may occur.

Hereinafter, described is controlling a circulation pump together to prevent a user from perceiving such noise in response to switching a position of the coupler 600.

Figure 9:
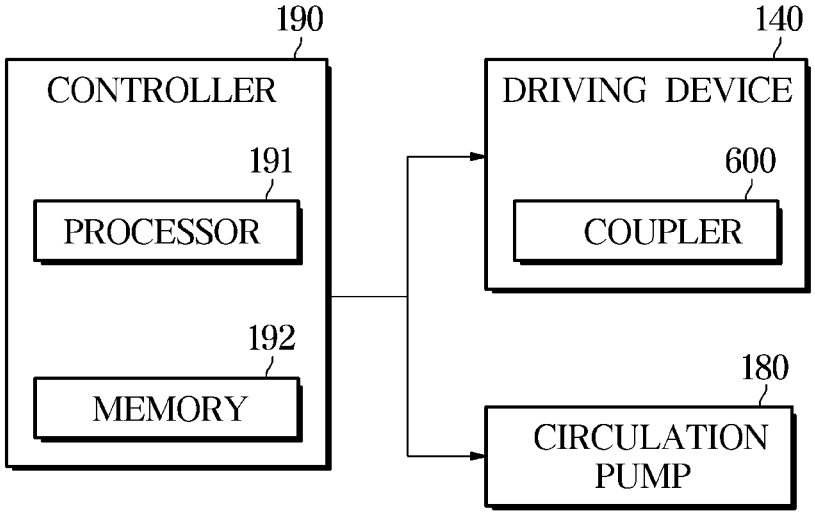
FIG. 9 is a control block diagram of the washing machine according to an embodiment.

FIG. 9 is a control block diagram of the washing machine according to an embodiment.

As described above, the washing machine 100 may include a main body, the tub 120 disposed inside the main body to accommodate wash water, the drum 130 rotatably provided inside the tub 120, the driving device 140 configured to provide power for rotating the drum 130, and the circulation pump 180 configured to circulate water in the tub 120 to supply water to the drum 130. The driving device 140 may include the coupler 600 configured to adjust a rotational speed of the drum 130, and the solenoid 410 configured to change a position of the coupler 600. The washing machine 100 may include a controller 190 configured to control operations of the driving device 140 and the circulation pump 180.

The controller 190 may include at least one processor and memory.

The controller 190 may include a memory 192 storing a control program and control data for controlling the driving device 140 and the circulation pump 180, and at least one processor 191 generating a control signal according to the control program and the control data stored in the memory. The memory 192 and the processor 191 may be provided integrally or separately.

The memory 192 may store programs and data for controlling the driving device 140 and the circulation pump 180.

The memory 192 may include a volatile memory, such as Static Random Access Memory (SRAM) or Dynamic Random Access Memory (DRAM) for temporary data storage, and a non-volatile memory, such as Read Only Memory (ROM), Erasable Programmable Read Only Memory (EPROM), and Electrically Erasable Programmable Read Only Memory (EEPROM) for long-term data storage.

The processor 191 may include various types of logic circuits and operational circuits, process data according to the program provided from the memory 192, and generate a control signal according to a result of the processing.

As described above, the controller 190 may adjust a rotational speed of the drum 130 by changing a position of the coupler 600 by applying current to the solenoid 410.

Specifically, the position of the coupler 600 may be changed by supplying currents in different directions to the solenoid 410.

In response to the position of the coupler 600 being changed from the first position to the second position or from the second position to the first position, noise such as a hitting noise of components may occur. To mask the above noise, the controller 190 may control the position change of the coupler 600 to be performed while the circulation pump 180 is operating.

That is, the controller 190 may control the solenoid 410 to change the position of the coupler 600 while the circulation pump 180 is operating.

In general, a noise generated by the operation of the circulation pump 180 is greater than a noise generated by the position change of the coupler 600. Accordingly, by changing the position of the coupler 600 while the circulation pump 180 is operating, the noise caused by the position change of the coupler 600 may be masked, and thus a user, or the like, may not perceive the noise caused by the position change of the coupler 600.

Hereinafter, various examples in which the position of the coupler 600 is changed during the operation of the circulation pump 180 are described in detail.

Figure 10:
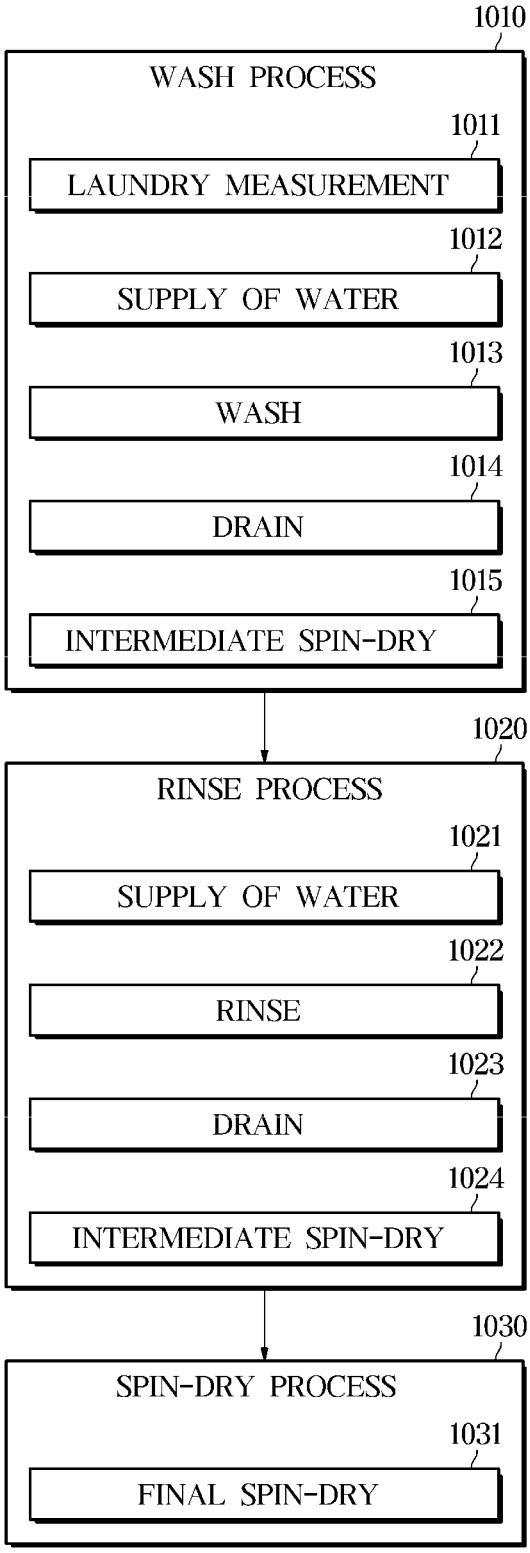
FIG. 10 illustrates an example of an operation cycle of the washing machine according to an embodiment.

FIG. 10 illustrates an example of an operation cycle of the washing machine according to an embodiment.

Referring to FIG. 10, the washing machine 100 may sequentially perform a wash process 1010, a rinse process 1020 and a spin-dry process 1030 according to a user input.

By the wash process 1010, laundry may be washed. Specifically, foreign substances attached to the laundry may be separated by a chemical action of detergent and/or a mechanical action, such as falling.

The wash process 1010 may include a laundry measurement 1011 for measuring the amount of laundry, a supply of water 1012 for supplying water to the tub 120, a wash 1013 for washing laundry by rotating the drum 130 at low speed, a drain 1014 for discharging water accommodated in the tub 120, and an intermediate spin-dry 1015 for separating water from laundry by rotating the drum 130 at high speed.

For the wash 1013, the controller 190 may control a drive circuit 200 to rotate the motor 141 forward (e.g., a clockwise direction) or backward (e.g., a counterclockwise direction). By the rotation of the drum 30, the laundry falls from the upper side of the drum 30 to the lower side, and thus the laundry may be washed by the falling.

For the intermediate spin-dry 1015, the controller 190 may control the drive circuit 200 to rotate the motor 141 at high speed. By the high-speed rotation of the drum 130, water may be separated from the laundry accommodated in the drum 130, and thus discharged to the outside of the washing machine 1.

During the intermediate spin-dry 1015, the rotational speed of the drum 130 may be increased. The controller 190 may control the driving device 140 to increase the rotational speed of the drum 130.

By the rinse process 1020, the laundry may be rinsed. Specifically, detergents or foreign substances left on the laundry may be washed away with water.

The rinse process 1020 may include a supply of water 1021 for supplying water to the tub 120, a rinse 1022 for rinsing the laundry by driving the drum 130, a drain 1023 for discharging the water accommodated in the tub 120, and an intermediate spin-dry 1024 for separating water from the laundry by driving the drum 130.

The supply of water 1021, the drain 1023 and the intermediate spin-dry 1024 of the rinse process 1020 may be the same as the supply of water 1012, the drain 1014 and the intermediate spin-dry 1015 of the wash process 1010, respectively. During the rinse process 1020, the supply of water 1021, the rinse 1022, the drain 1023 and the intermediate spin-dry 1024 may be performed once or several times.

By the spin-dry process 1030, laundry may be dehydrated. Specifically, water may be separated from the laundry by rotating the drum 130 at high speed, and the separated water may be discharged to the outside of the washing machine 1.

The spin-dry process 1030 may include a final spin-dry 1031 in which the drum 130 is rotated at high speed to separate water from the laundry. Due to the final spin-dry 1031, the last intermediate spin-dry 1024 of the rinse process 1020 may be omitted.

For the final spin-dry 1031, the controller 190 may control the driving device 140 to increase the rotational speed of the drum 130.

Because the operation of the washing machine 1 ends with the final spin-dry 1031, the operation time of the final spin-dry 1031 may be longer than the operation time of the intermediate spin-dry 1015 or 1024.

As described above, the washing machine 100 may perform the wash process 1010, the rinse process 1020 and the spin-dry process 1030 to wash the laundry. In particular, during the intermediate spin-dry 1015 or 1024 and the final spin-dry 1031, the washing machine 100 may increase the rotational speed of the drum 130, and to this end, the controller 190 may control the driving device 140 to increase the rotational speed of the drum 130.

The operations for controlling the rotational speed of the drum 130 have been described in detail above with reference to FIG. 3 to FIG. 8.

The rinse process described throughout the specification may refer to all of the intermediate spin-dry 1015 performed in the wash process 1010, the intermediate spin-dry 1024 performed in the rinse process 1020, and the final spin-dry 1031 performed in the spin-dry process 1030. Hereinafter, however, for convenience of description, it is assumed that a spin-dry process is the final spin-dry 1031 of the spin-dry process 1030 performed after the rinse process 1020.

In a case where the wash process or the rinse process is switched to the spin-dry process, or in a case where the spin-dry process is switched to the wash process or the rinse process, a position of the coupler 600 in the driving device 140 is switched to adjust the rotational speed of the drum 130.

Here, the controller 190 may change the position of the coupler 600 from the second position to the first position, in response to the wash process or the rinse process being switched to the spin-dry process. Also, in response to the spin-dry process being switched to the wash process or the rinse process, the controller 190 may change the position of the coupler 600 from the first position to the second position.

As described above, the coupler 600 may be engaged with the rotor 200 at the first position. Because the rotational speed of the drum 130 is required to be relatively fast during the spin-dry process, the drum may rotate at the first speed in response to the coupler 600 being located at the first position.

In addition, the coupler 600 may be engaged with the stator 205 at the second position. Because the rotational speed of the drum 130 is required to be relatively slow during the wash process or the rinse process, the drum may rotate at the second speed in response to the coupler 600 being positioned at the second position.

Here, the first speed may be higher than the second speed.

To prevent a user from perceiving a noise generated by the position switch of the coupler 600, the noise may be masked by a noise generated while the circulation pump 180 is operating, which is described in detail below.

FIG. 11 to FIG. 14 are diagrams illustrating a position switch of a clutch during operation of a circulation pump according to an embodiment. FIG. 15 is a diagram illustrating a level of noise generated during circulation operation and clutch position switch.

During the wash process or the rinse process, the drum 130 may have a plurality of rotation periods. That is, the drum 130 may form the plurality of rotation periods that alternately rotate clockwise CW and counterclockwise CCW during the wash process or the rinse process.

Here, the circulation pump 180 may be controlled to operate in each rotation period or may be controlled to continuously operate during the wash process or the rinse process.

First, a case where the wash process or the rinse process is switched to the spin-dry process is described.

The controller 190 may change a position of the coupler 600 before a last rotation period of the plurality of rotation periods of the drum 130 starts while the circulation pump 180 is operating in the wash process or the rinse process.

In general, after the wash process or the rinse process is completed, the position of the coupler 600 is changed and then the spin-dry process proceeds. However, because the circulation pump 180 does not operate after the wash process or the rinse process is completed, the position of the coupler 600 may be changed while the circulation pump 180 is operating before the end of the wash process or the rinse process.

Figure 11:
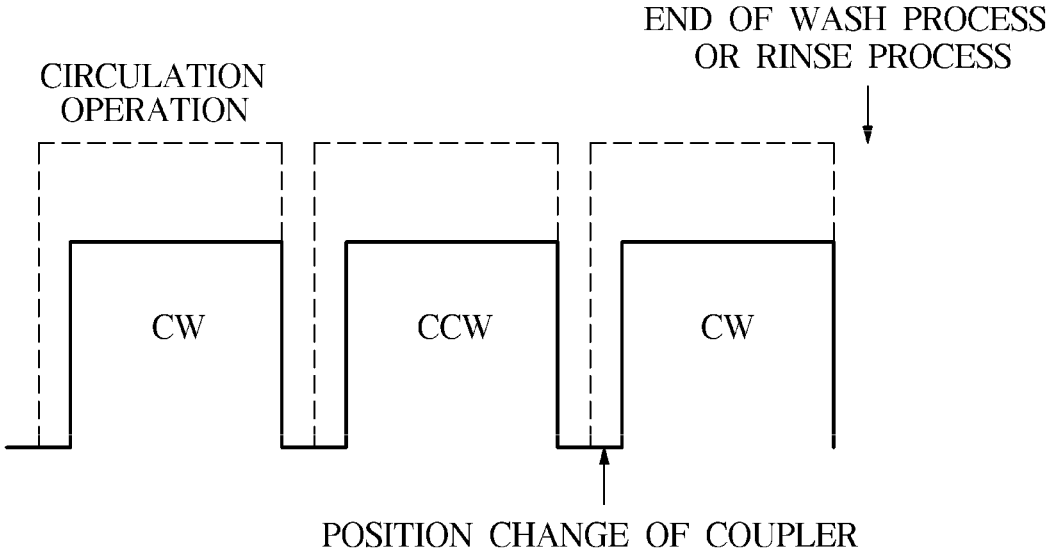
FIG. 11 to FIG. 14 are diagrams illustrating a position switch of a clutch during operation of a circulation pump according to an embodiment.

Referring to FIG. 11, the circulation pump 180 may be controlled to operate in each rotation period. That is, as the drum 130 alternately rotates clockwise or counterclockwise, the circulation pump 180 may also be operated in each rotation period while repeatedly being turned on and off.

In this instance, because the position of the coupler 600 may be changed before the last rotation period of the plurality of rotation periods of the drum 130 starts, the circulation pump 180 may be controlled to operate before changing the position of the coupler 600.

That is, the position of the coupler 600 may be changed after the circulation pump 180 is operated as shown in FIG. 11, thereby masking a noise from the coupler 600 with a noise from the circulation pump 180.

Figure 13:
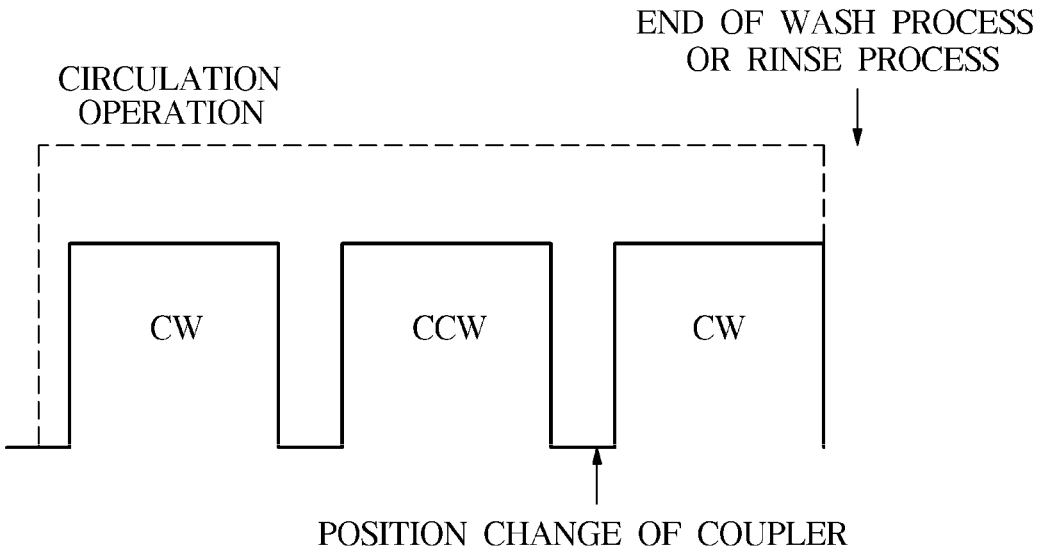

Referring to FIG. 13, the circulation pump 180 may be controlled to operate continuously during the wash process or the rinse process.

In this instance, because the position of the coupler 600 may be changed before the last rotation period of the plurality of rotation periods of the drum 130 starts and the circulation pump 180 is still operating, the noise from the coupler 600 may be masked with the noise from the circulation pump 180.

Next, a case where the spin-dry process is switched to the wash process or the rinse process is described.

The controller 190 may change a position of the coupler 600 after a first rotation period of the plurality of rotation periods of the drum 130 is completed while the circulation pump 180 is operating in the wash process or the rinse process.

In general, after the spin-dry process is completed, the position of the coupler 600 is changed and then the wash process or the rinse process proceeds. However, because the circulation pump 180 does not operate before the wash process or the rinse process starts, the position of the coupler 600 may be changed while the circulation pump 180 is operating after the wash process or the rinse process starts.

Figure 12:
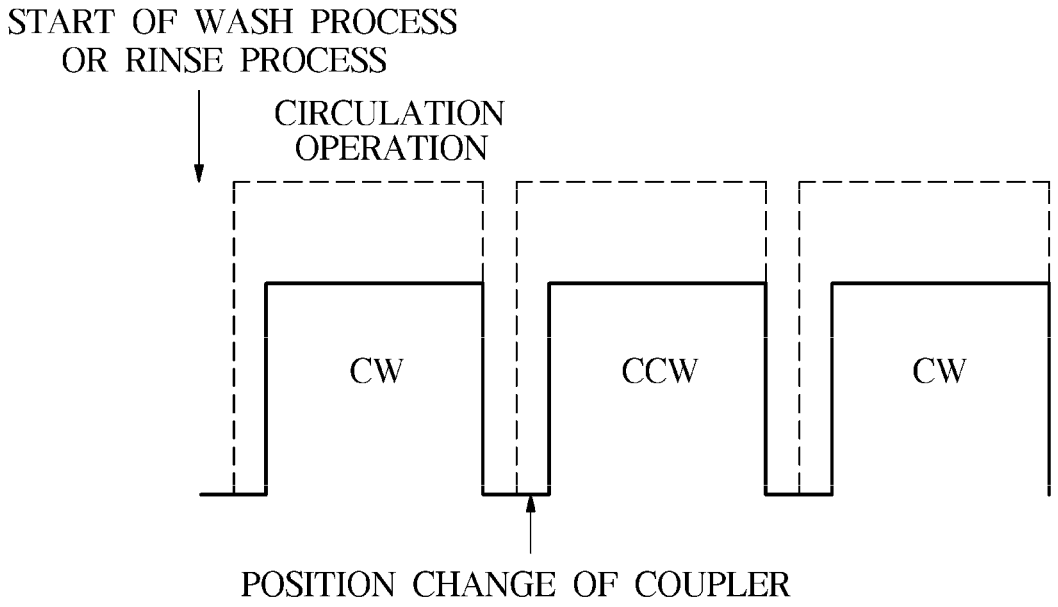

Referring to FIG. 12, the circulation pump 180 may be controlled to operate in each rotation period. That is, as the drum 130 alternately rotates clockwise or counterclockwise, the circulation pump 180 may also be operated in each rotation period while repeatedly being turned on and off.

In this instance, because the position of the coupler 600 may be changed after the first rotation period of the plurality of rotation periods of the drum 130 is completed, the circulation pump 180 may be controlled to operate before changing the position of the coupler 600.

That is, the position of the coupler 600 may be changed after the circulation pump 180 is operated as shown in FIG. 12, thereby masking a noise from the coupler 600 with a noise from the circulation pump 180.

Figure 14:
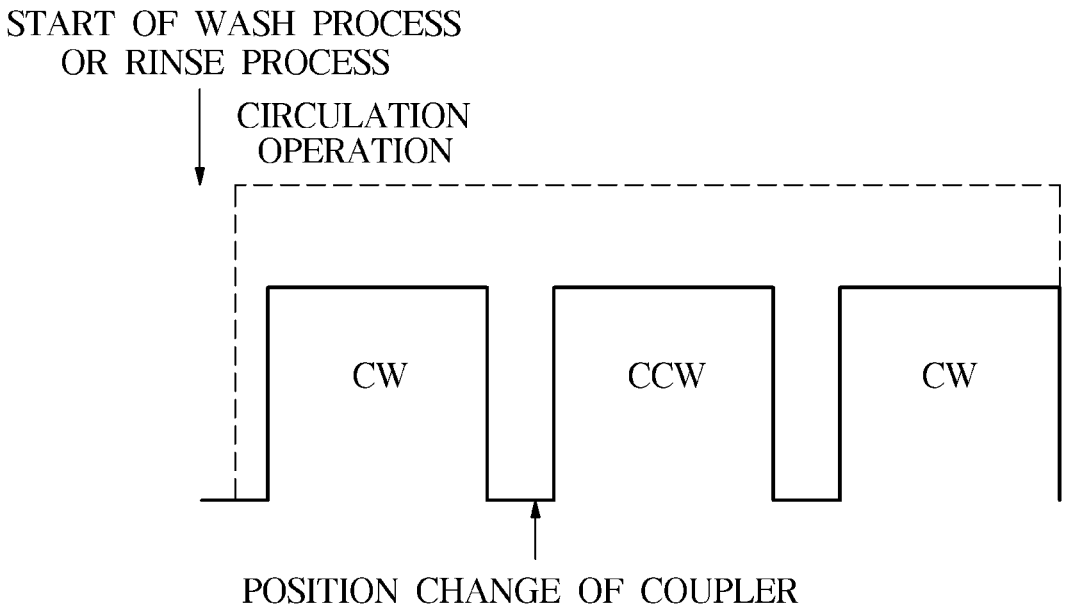

Referring to FIG. 14, the circulation pump 180 may be controlled to operate continuously during the wash process or the rinse process.

In this instance, because the position of the coupler 600 may be changed after the first rotation period of the plurality of rotation periods of the drum 130 is completed and the circulation pump 180 is still operating, the noise from the coupler 600 may be masked with the noise from the circulation pump 180.

Referring to FIG. 15, it may be seen that the noise generated during the operation of the circulation pump 180 is 51 [dBA], and the noise generated by the position switch of the coupler 600 is 48 [dBA].

Because the noise generated during the operation of the circulation pump 180 is greater than the noise generated by the position switch of the coupler 600, the noise generated by the position switch of the coupler 600 may be effectively masked by changing the position of the coupler 600 during the operation of the circulation pump 180.

Figure 16:
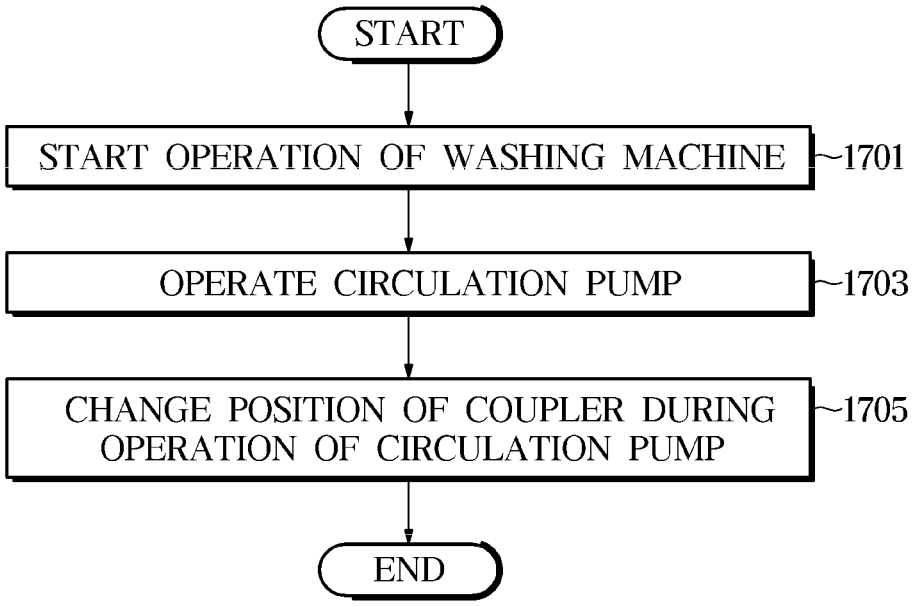
FIG. 16 is a flowchart of a control method of the washing machine according to an embodiment.

FIG. 16 is a flowchart of a control method of the washing machine according to an embodiment.

Once the washing machine starts operating 1701, the circulation pump 180 may be controlled to operate in a wash process or a rinse process 1703.

In this instance, by changing 1705 a position of the coupler 600 while the circulation pump 180 is operating, the noise generated by the position switch of the coupler 600 may be masked by the noise generated during the operation of the circulation pump 180.

Specifically, in response to the wash process or the rinse process being switched to the spin-dry process, the position of the coupler 600 may be changed before a last rotation period of a plurality of rotation periods of the drum 130 starts while the circulation pump 180 is operating. Accordingly, the position switch noise of the coupler 600 may be masked.

In addition, in response to the spin-dry process being switched to the wash process or the rinse process, the position of the coupler 600 may be changed after a first rotation period of the plurality of rotation periods of the drum 130 is completed while the circulation pump is operating. Accordingly, the position switch noise of the coupler 600 may be masked.

According to the disclosure, the noise from clutch position switch may be masked with the noise from circulation operation by performing a position switch of a clutch to adjust a rotational speed of a drum while the circulation pump is operating, so as to prevent a user from perceiving the clutch position switch noise.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the computer-readable recording medium may be read only memory (ROM), random access memory (RAM), a magnetic tape, a magnetic disc, a flash memory, an optical data storage device, etc.

Although embodiments of the disclosure have been described with reference to the accompanying drawings, a person having ordinary skilled in the art will appreciate that other specific modifications may be easily made without departing from the technical spirit or essential features of the disclosure. Therefore, the foregoing embodiments should be regarded as illustrative rather than limiting in all aspects.

The invention claimed is:

1. A washing machine, comprising:

a tub to accommodate wash water;

a drum inside the tub;

a driving device configured to rotate the drum, the driving device including:

a coupler configured to move between a first position and a second position to adjust a rotational speed of the drum, and a solenoid configured to move the coupler between the first position and the second position in response to an electric current flowing through the solenoid;

a circulation pump configured to operate to circulate the wash water in the tub; and a controller configured to determine when the circulation pump is operating and to control the electric current flowing through the solenoid to move the coupler between the first position and the second position while the circulation pump is determined to be operating.

2. The washing machine of claim 1, wherein the controller is configured to control the electric current flowing through the solenoid to move the coupler between the first position and the second position by changing a direction that the electric current is supplied to the solenoid between a first direction and a second direction.

3. The washing machine of claim 1, wherein the controller is configured to control the driving device to rotate the drum for a plurality of rotation periods, and control the electric current flowing through the solenoid to move the coupler between the first position and the second position before a last rotation period of the plurality of rotation periods of the drum starts while the circulation pump is operating in a wash process or a rinse process.

4. The washing machine of claim 3, wherein the controller is configured to start operating the circulation pump before controlling the electric current flowing through the solenoid to move the coupler between the first position and the second position, and stop operating the circulation pump after controlling the electric current flowing through the solenoid to move the coupler between the first position and the second position.

5. The washing machine of claim 3, wherein the controller is configured to operate the circulation pump during the wash process or the rinse process.

6. The washing machine of claim 3, wherein the plurality of rotation periods of the drum include a period in which the drum alternately rotates clockwise (CW) and counterclockwise (CCW).

7. The washing machine of claim 1, wherein the controller configured to control the driving device to rotate the drum for a plurality of rotation periods, and is configured to control the electric current flowing through the solenoid to move the coupler between the first position and the second position after a first rotation period of the plurality of rotation periods of the drum is completed while the circulation pump is determined to be operating in a wash process or a rinse process.

8. The washing machine of claim 7, wherein the controller is configured to start operating the circulation pump before controlling the electric current flowing through the solenoid to move the coupler between the first position and the second position, and stop operating the circulation pump after controlling the electric current flowing through the solenoid to move the coupler between the first position and the second position.

9. The washing machine of claim 7, wherein the controller is configured to operate the circulation pump during the wash process or the rinse process.

10. The washing machine of claim 7, wherein the plurality of rotation periods of the drum include a period in which the drum alternately rotates clockwise (CW) and counterclockwise (CCW).

11. The washing machine of claim 2, wherein the controller is configured to change the direction that electric current is supplied to the solenoid to move the coupler from the second position to the first position, in response to switching a wash process or a rinse process to a spin-dry process, and change the direction that electric current is supplied to the solenoid to move the coupler from the first position to the second position, in response to switching the spin-dry process to the wash process or the rinse process.

12. The washing machine of claim 11, wherein when the driving device rotates the drum, the drum is configured to:

rotate at a first speed when the coupler s located in the first position, and rotate at a second speed when the coupler is located in the second position, and wherein the first speed is higher than the second speed.

13. A control method of a washing machine including a tub to accommodate wash water, a drum inside the tub, a circulation pump configured to operate to circulate the wash water in the tub, and a driving device configured to rotate the drum, the driving device including a coupler configured to move between a first position and a second position to adjust a rotational speed of the drum, and a solenoid configured to move the coupler between the first position and the second position in response to an electric current flowing through the solenoid, the control method comprising:

determining when the circulation pump is operating; and controlling the electric current flowing through the solenoid to move the coupler between the first position and the second position while the circulation pump is determined to be operating.

14. The control method of claim 13, wherein the controlling includes changing a direction that the electric current is supplied to the solenoid.

15. The control method of claim 13, further comprising:

rotating the drum with the driving device for a plurality of rotation periods; and wherein the controlling includes controlling the electric current flowing through the solenoid to move the coupler between the first position and the second position before a last rotation period of the plurality of rotation periods of the drum starts while the circulation pump is determined to be operating in a wash process or a rinse process.

* * * * *